United States Patent [19]

Taylor

[11] Patent Number: 4,690,195

[45] Date of Patent: Sep. 1, 1987

[54] APPARATUS FOR OPENING AND CLOSING INDUSTRIAL DOOR

[75] Inventor: Douglas B. Taylor, Barrie, Canada

[73] Assignee: Cooper Cliff Door Manufacturing (1980) Ltd., Barrie, Canada

[21] Appl. No.: 877,520

[22] Filed: Jun. 23, 1986

[30] Foreign Application Priority Data

Nov. 14, 1985 [CA] Canada ..... 495376

[51] Int. Cl.[4] ..... E06B 9/204

[52] U.S. Cl. ..... 160/310; 160/265; 160/133; 160/271; 74/354

[58] Field of Search ..... 160/310, 311, 133, 23 R, 160/265, 66, 68, 321; 74/354, 384

[56] References Cited

U.S. PATENT DOCUMENTS

| | | | |
|---|---|---|---|
| 1,294,094 | 2/1919 | Groff | 160/321 X |
| 1,936,300 | 11/1933 | Guss | 186/46 |
| 2,390,117 | 12/1945 | Michelman | 160/321 X |
| 2,738,179 | 3/1956 | Joy | 262/34 |
| 2,819,628 | 1/1958 | Wardlaw | 74/625 |
| 2,957,521 | 10/1960 | Greegor | 160/133 |
| 3,522,834 | 8/1970 | Corcoran | 160/23 R |
| 3,637,004 | 1/1972 | Wardlaw et al. | 160/133 |
| 3,768,540 | 10/1973 | McSwain | 160/23 R |
| 3,853,167 | 12/1974 | Wardlaw | 160/133 |
| 3,900,063 | 8/1975 | Roller | 160/310 |
| 3,989,084 | 11/1976 | Inamura et al. | 160/36 |
| 4,342,354 | 8/1982 | Leivenzon | 160/310 X |
| 4,411,348 | 10/1983 | Fillion | 160/310 X |
| 4,478,268 | 10/1984 | Palmer | 160/310 |
| 4,615,371 | 10/1986 | Clauss | 160/310 X |

*Primary Examiner*—Ramon S. Britts
*Assistant Examiner*—David M. Purol
*Attorney, Agent, or Firm*—Krass & Young

[57] ABSTRACT

An operator for a rolling door having a curtain barrel shaft rotatable for actuating the door and including a drive gear adapted for connection to one end of the curtain barrel shaft and a second gear adapted for connection to one end of an idler roller. The idler roller in use engages one surface of the door and extends horizontally across the top of the door opening. A third gear is rotatably mounted in the region of the drive gear and the second gear and an electric motor is provided to rotate this third gear. In one version of the invention there is a moveable fourth gear in meshing engagement with the third gear and driven thereby. The fourth gear can be swung from a first position where it is in meshing engagement with the second gear to a second position where it is in meshing engagement with the drive gear. A chain loop connectable to the door is driven when the second gear and the idler roller rotate and it is provided to close the door even under pressure. In a second version, a floating clutch drive system employing an endless chain is employed to selectively drive either the shaft about which the door is rolled or the chain loop.

11 Claims, 13 Drawing Figures

APPARATUS FOR OPENING AND CLOSING INDUSTRIAL DOOR

BACKGROUND OF THE INVENTION

This invention relates to rolling doors and in particular operating systems for opening and closing doors of this type.

The use of rolling doors, particularly for industrial applications and for mining, is well known. These doors can be of various constructions including flexible doors made from rubber or plastic sheets. The door is rolled up about a horizontal shaft extending across the top of the door opening. There can be a spring loaded barrel arranged on the shaft about which the door is rolled. The purpose of this barrel is to overcome the gravitational forces acting on the door so that the door will open with relative ease. It is common to provide an electric operator including an electric motor to open and close the door. Vertical guideways are generally provided along the sides of the doorway to accommodate the edges of the flexible door.

In U.S. Pat. No. 4,478,268 issued Oct. 23, 1984 to Copper Cliff Door Manufacturing (1980) Ltd., there is described a roll-up door made from a strong rubber curtain. Since the curtain is of rubber, if it is struck by a vehicle accidently it will give with the force and, unless it is hit with considerable speed, it will be substantially undamaged. With this door it is generally a simple operation to reinsert the rubber curtain back into its vertical guide channels and make the door operational again. A motor and clutch is provided to open the door. A chain drive extends from the clutch to the shaft about which the door is rolled. A worm and screw arrangement is provided between the drive shaft of the motor and the clutch.

Although the door of the above-mentioned United States patent has been found to be generally satisfactory, difficulties have been encountered with the closing of such doors when there is a pressure differential between one side of the door and the other. This situation is encountered most frequently in mining situations. Often a section of the mine must be kept under pressure in order to maintain the mine in an operational and safe condition. Where a pressure differential exists, the friction between the vertical edges of the rolling door and the guideways can build up to such an extent that the door will not close satisfactorily.

U.S. Pat. No. 2,819,628 issued Jan. 14, 1958 to Coolsson Company describes a control device for a rolling door that includes a power operated mechanism and a hand chain mechanism for controlling the door. The main shaft is adapted to be rotated by either the power operated mechanism or the hand chain mechanism. The latter consists of a hand chain loop which has one end looped about and engaging a chain sprocket. The chain is of sufficient length that it can be reached by a person standing on the floor. A spur gear is adapted to be moved into meshing engagement with either of two pinions by means of a Scotch yoke mechanism. If it is desired to raise or lower the curtain by the motor, an operating rod is pulled to its lowermost position, which operation serves to urge the yoke downwardly. This results in the spur gear moving into engagement with the pinion that is driven by the motor. There is no means provided in the device of this patent for pulling the flexible curtain downwardly in its guideways.

More recent U.S. Pat. No. 3,853,167 issued Dec. 10, 1974 to The Cookson Company describes a driving mechanism for a rolling door that includes a motor driven gear box which is selectively coupled by an electro-mechanical clutch and a manual operating mechanism. A safety brake coupled between the clutch and manual operator prevents driving of the manual operator by the motor should the clutch fail to disengage and functions as a stopping brake whenever the motor is stopped. In this known device a main drive sprocket is mounted on the end of the axle of the curtain barrel. The main drive sprocket is connected by means of a drive chain to a smaller sprocket mounted on the output drive shaft of the gear box.

It is an object of the present invention to provide an operator for a rolling door which provides both a power operated means for rolling the door up and a means for pulling the door downwards to the closing position under power. Thus, a rolling door provided with the operator of this invention can be used in at least a medium pressure environment such as the type found in many mines.

SUMMARY OF THE INVENTION

According to the invention, a power operator for a rolling door includes a first rotatable shaft with a barrel arranged thereon, the barrel being adapted for a door to be rolled up thereon and sprocket means mounted on one end of the shaft. An idler roller for engaging one surface of the door is adapted to extend horizontally across the top of an opening to be closed by the door. Second shaft means extend from opposite ends of the roller and second sprocket means are mounted on the second shaft means at one end of the roller. Power means open and close the door and a third sprocket is operatively connected to this power means. An endless chain extends about and engages the drive sprocket means, the second sprocket means and the third sprocket. There are first means for selectively transmitting rotational power from the third sprocket to the drive sprocket means via the endless chain in order to open the door. Second means are provided for selectively transmitting rotational power from the third sprocket to the second sprocket means via the endless chain in order to close the door. Further means operatively connect a bottom end of the door to the second shaft means whereby rotation of the second shaft means in one direction will cause the door to be pulled towards the closed position.

Preferably the connecting means includes two chain loops for mounting on opposite vertical sides of the opening to be closed by the door and upper and lower sprockets for each chain loop. Each lower sprocket is adapted to be rotatably mounted at or near the bottom of the opening and each upper sprocket is mounted on the second shaft means for rotation therewith.

Further features and advantages will become apparent from the following detailed description of two preferred embodiments when taken in conjunction with the accompanying drawings.

DETAILED DESCRIPTION OF PREFERRED EMBODIMENTS

Figure 1:
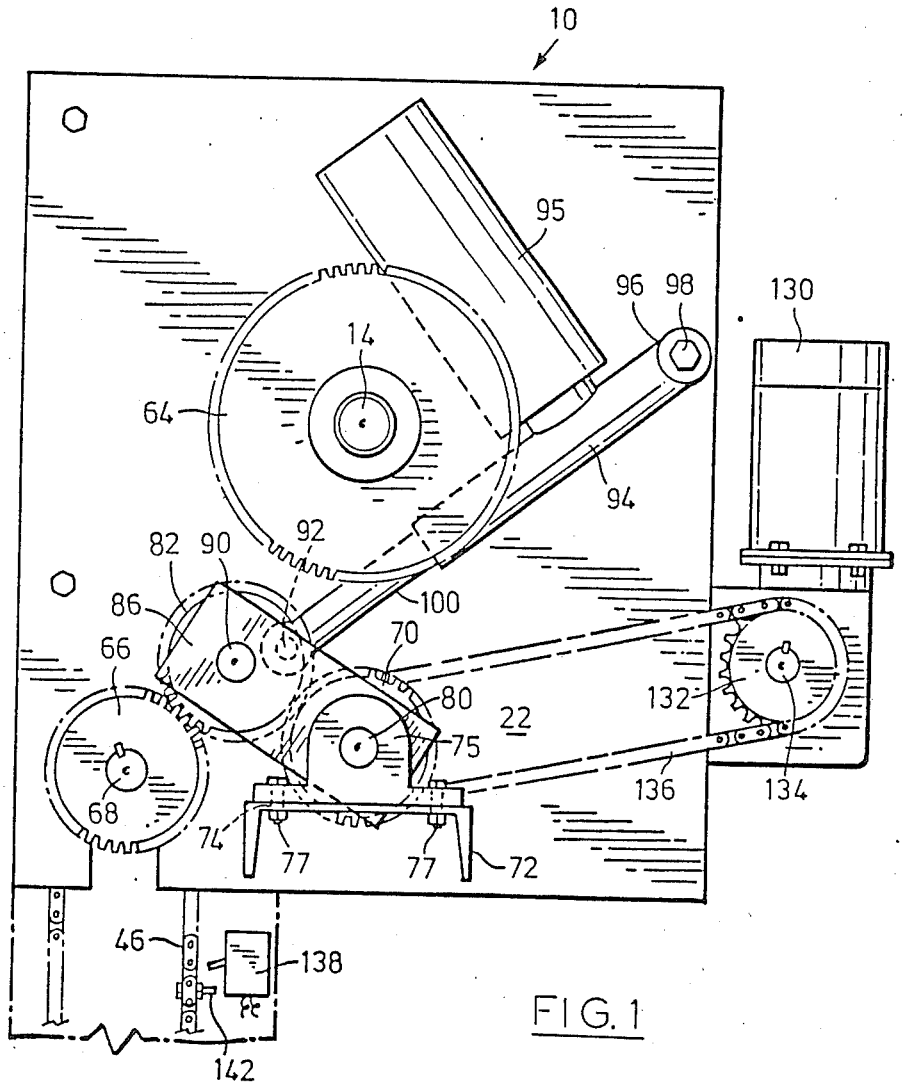
FIG. 1 is a side elevation showing an operator for a rolling door.
Figure 2:
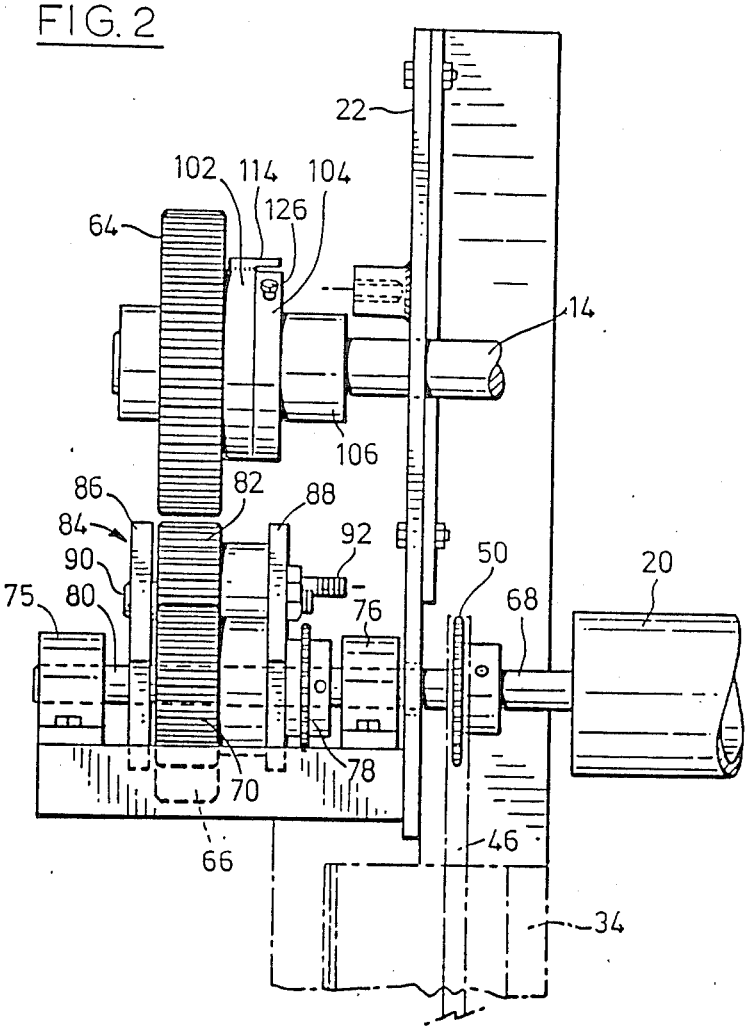
FIG. 2 is an elevational view taken from the right hand side of FIG. 1 but omitting the electromechanical actuator for moving the swivel gear and the electric operator and the drive sprocket connected thereto for sake of illustration.
Figure 3:
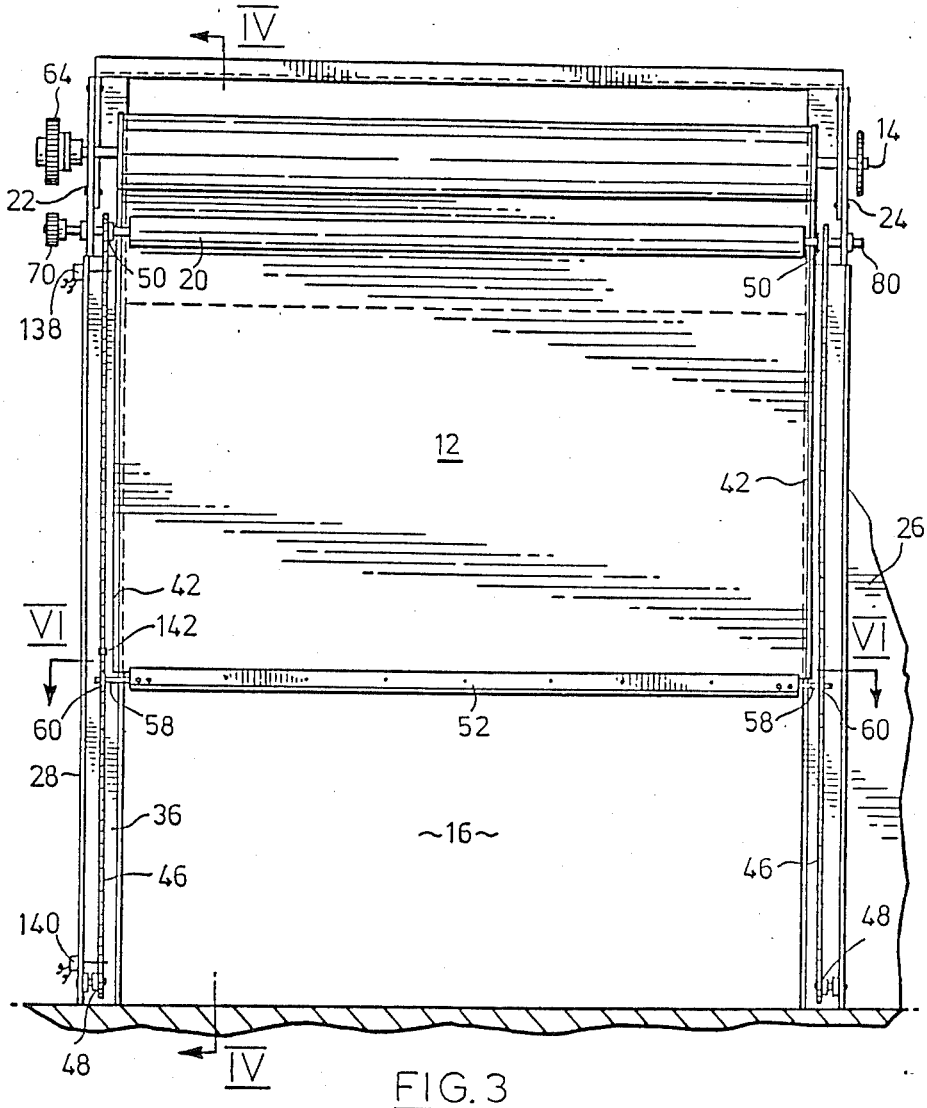
FIG. 3 is a front elevational view illustrating general construction of a roll-up door provided with a gear drive system, some of the components of the gear drive system being omitted for simplicity.
Figure 6:
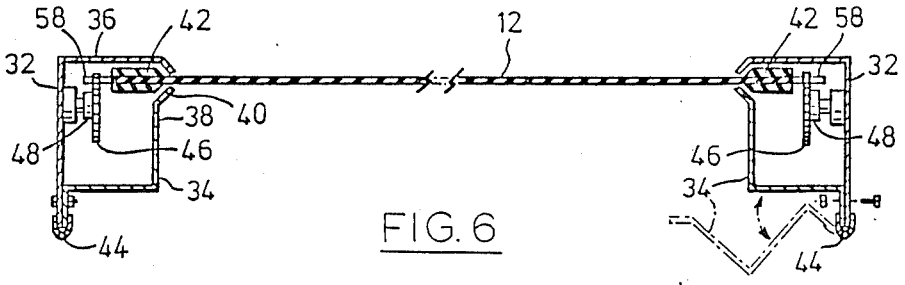
FIG. 6 is a horizontal cross-section taken along the line VI—VI of FIG. 3 but to a larger scale, showing the construction of the guideways that accommodate the chain loops.

An operator 10 for a rolling door 12 is shown in detail in FIGS. 1 and 2. The door 12, which can be seen most clearly in FIG. 3, is preferably constructed from a flexible rubber or synthetic rubber sheet which is able to withstand a bump from a collision passing through the door. The door is rolled around a main horizontal shaft 14 that extends across the top of the door opening 16 shown in FIG. 3. In a known manner, a drum or barrel 18 is mounted on the shaft 14 and the upper end of the door 12 is connected to this barrel. The construction of this spring loaded barrel is well known and is described for example in U.S. Pat. No. 4,478,268. Briefly, torsion springs are mounted inside the barrel at one end and these help to wind up the door 12. Mounted below the barrel 18 and slightly behind it is a guide roller or idler roller 20 which also is of known construction. This roller is rotatably mounted in support brackets 22 and 24 that are connected to the wall or structure 26 adjoining the door opening. The purpose of the roller 20 is to guide the flexible door along the correct path into vertical guide channels 28 and 30, the construction of which can be seen clearly from FIG. 6.

Each of the guide channels 28 and 30 is constructed in essentially the same manner and therefore reference will be made herein only to guide channel 28. Each guide channel is constructed of two members 32 and 34 which are preferably made of steel. The member 32 has an arm 36 that extends parallel to the wall 26 and that can be connected thereto. The end of the arm 36 extends inwardly at an angle towards the door 12. The guide member 34 is normally rigidly connected to the member 32 by means of nuts and bolts (not shown). The member 34 has an arm 38 that extends substantially perpendicular to the arm 36 except for an end portion 40 that extends at an angle. It will be understood that the angled ends of members 36 and 38 act to retain the thickened side edge 42 of the door in the guide channel. However, the guide member 34 is sufficiently flexible and resilient that the side edge of the door can be pulled out from the guide channel without significant damage to the door when the door is accidently struck by a vehicle. In order to permit reinsertion of the side edge of the door into the guide channel, the member 34 can be swung about hinges 44 that connect the members 32 and 34 together. In order to swing the guide member 34 outwardly, it is necessary to remove the bolts that normally connect the member 34 to the member 32.

Figure 5:
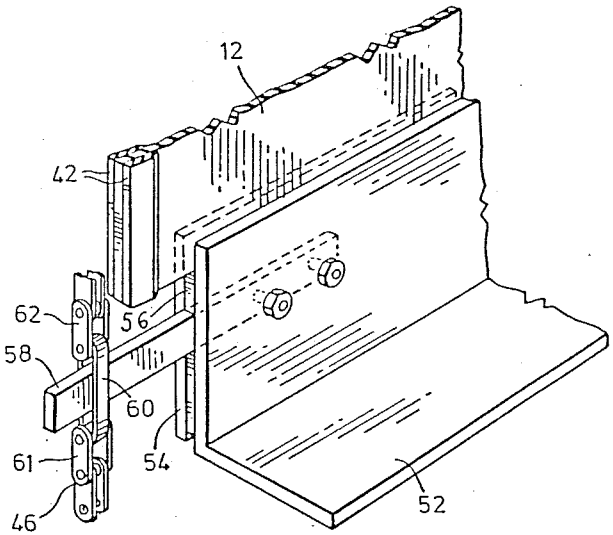
FIG. 5 is an isometric detail view illustrating how the bottom of the curtain is connected to the chain loop.
Figure 4:
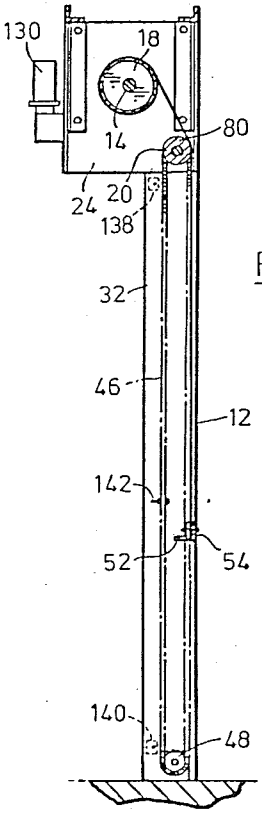
FIG. 4 is a sectional elevation taken along the line IV—IV FIG. 3 and illustrating the construction of the chain loop that acts to pull the door downwards.

Mounted in each guide channel means is a chain loop means 46 that is connected to the bottom edge of the door 12 in the manner shown in FIGS. 3 and 5. Each chain loop means comprises an endless chain mounted on first sprocket means 48 rotatably mounted at or near the bottom of the door opening 16 and second sprocket means 50 mounted on an end shaft of the idler roller 20. The path of the chain loop means 46 can be seen clearly from FIG. 4.

The construction of the bottom edge of the door 12 which is connected to the chain loops can be seen in FIGS. 3 and 5. There is an elongate angle member 52 connected by nuts and bolts to a flat metal strip 54. Sandwiched tightly between the angle member and the metal strip is the bottom edge portion 56 of the rubber door. Extending outwardly from the bottom edge portion of the door at each side thereof is a metal finger 58. This finger 58 passes through a small loop member 60 which connects chain links 61 and 62 together. The two fingers 58 are connected by bolts and nuts to the T-bar formed by the angle member 52 and the strip 54. If the door 12 is impacted by heavy equipment the T-bar may bend and the small fingers 58 would come out of the loop member 60. The damage to the door under these circumstances is normally minimal as the edges of the curtain are pulled out of the guide channels relatively easily under impact. After impact the T-bar can be straightened or replaced if necessary. The small fingers 58 are again lined up with their respective loop members 60 and they are placed therein by spreading the endless chain loops 46 apart.

One type of operator for the rolling door 12 will now be described with particular reference to FIGS. 1 and 2. Mounted at one end of the main shaft 14 is a relatively large drive gear 64. A second, smaller gear 66 is mounted on a second shaft 68 that extends from one end of the idler roller 20. A third gear 70 is rotatably mounted in the region of the drive gear 64 and second gear 66 on a channel support 72. The support 72 is connected by welding to the support bracket 22 and it has a rectangular hole therein to accommodate the bottom portion of the gear 70. Pillow block ball radial bearings 75 and 76 are mounted by bolts 77 extending through holes 74 on the channel support 72. The shaft 80 for the gear 70 extends through these bearings. The gear 70 is rotated by means of an adjacent sprocket 78 which also rotates about the shaft 80.

A moveable fourth gear 82 is in meshing engagement with the third gear 70 at all times and is driven thereby. Means are provided for moving the fourth gear from a first position (shown in FIG. 1) where it is in meshing engagement with the second gear 66 and not with the drive gear 64 to a second position where it is in meshing engagement with the drive gear and not with the second gear. The moving means include link means 84 that are pivotably connected to the shaft 80. The link means 84 comprise two rectangular, flat plates 86 and 88. Each of these plates has two holes therein to accommodate the shafts 80 and 90. The fourth gear 82 is mounted on the shaft 90. Extending from one side of the plate 88 is a pin 92 to which is connected an electro-mechanical actuator 94 of known construction. Thus the end of the actuator 94 at the pin 92 is able to pivot relative to the link means 84. The opposite end 96 of the actuator is pivotably connected to the fixed support bracket 22 by means of a bolt 98 and nut (not shown). Briefly, the actuator 94 includes an electric motor 95 which by means of a gear arrangement is able to extend or retract a piston member 100. Thus, retraction of the piston member 100 will move the fourth gear 82 to the above-mentioned second position where it engages the large drive gear.

Figure 7:
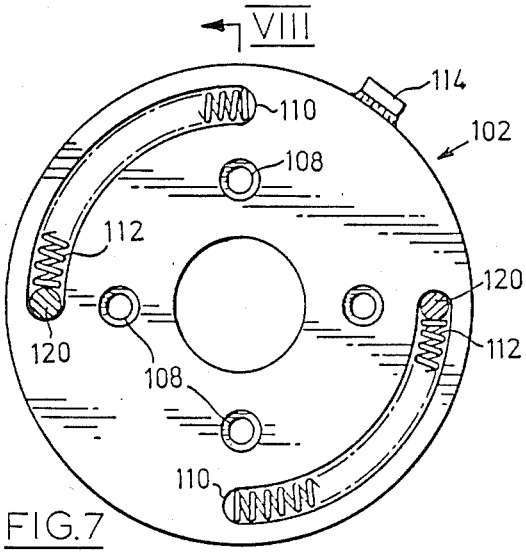
FIG. 7 is a side view of part of the spring hub provided for facilitating engagement of the drive gear used to open the door.
Figure 8:
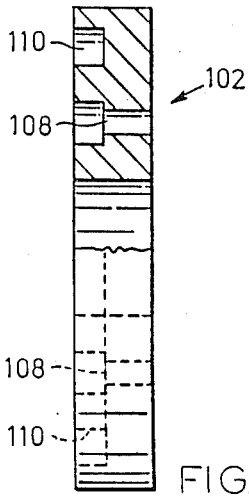
FIG. 8 is a right side view, partially in section, of the part shown in FIG. 7.
Figure 9:
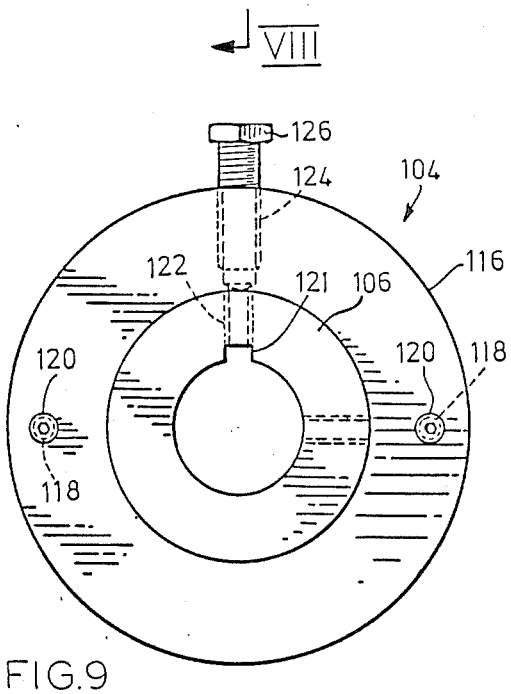
FIG. 9 is a side view of another part of the spring hub.
Figure 10:
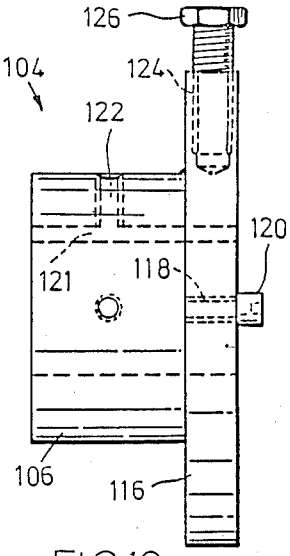
FIG. 10 is a right side view of the spring hub part shown in FIG. 9.

A special spring hub device is provided at the side of the drive gear 64 to provide a means for absorbing the initial shock when the rotating fourth gear 82 comes into initial contact with the larger drive gear. The spring hub includes a first annular disk member 102, the construction of which can be seen clearly from FIGS. 7 and 8, and a second part 104 having an inwardly extending collar 106. The disk member 102 is provided with four bolt holes 108 to permit attachment of this member to the side of the drive gear 64 by means of bolts (not shown). Formed in one side of the disk member 102 are two arcuate slots 110, each of which extends about the centre of the member slightly more than 90 degrees. Arranged in each arcuate slot is a suitable coil spring 112 which fills up most of the length of the slot. Welded to the perimeter of the disk member 102 is a flat bar 114 the purpose of which is to limit the amount of relative rotation between the disk member and the second part 104.

The second part 104 has a flange portion 116 with two bolt holes 118 formed therein. These bolt holes accommodate Allen bolts 120 which project from the side opposite the collar 106. The position of the ends of the Allen bolts is shown in dotted lines in FIG. 7. The ends of these bolts fit into the arcuate slots 110 at one end thereof where they are engaged by the adjacent end of the spring 112. With this spring hub arrangement, initial engagement of the drive gear 64 by the fourth gear 82 will not result in an immediate positive drive between the drive gear and the shaft 14. This is because the spring hub allows some initial rotation between the drive gear and the shaft. However, eventually the rotation of the fourth gear 82 will result in a positive engagement between its teeth and those of the drive gear. This will occur before the springs 112 become fully compressed and thus before a positive drive between the drive gear 64 and its shaft occurs. In this way, the teeth of the gear 64 and gear 82 are protected from grinding or stripping as gear 82 is rotating during engagement with gear 64.

Further features of the second part 104 include a key seat 121 to accommodate a key that prevents rotation of this part on the shaft 14. The collar 106 may be drilled and tapped at 122 to accommodate a set screw for holding the part 104 in its correct position on the shaft. Preferably, a further hole 124 is drilled and tapped into one side of the flange portion 116. A $\frac{3}{8}''$ bolt 126 is screwed into this hole 124 to provide a stop member for engaging the aforementioned flat bar 114. Preferably the bolt 126 and the flat bar are so arranged that the coil springs 112 will be compressed at the most approximately 40%. This prevents full compression of the springs which would eventually reduce the life of the springs.

There are power means for rotating the third gear 70. In the illustrated preferred embodiment (FIG. 1) there is an electric operator 130 which includes an electric motor and suitable reduction gearing for driving a drive sprocket 132. The sprocket 132 is mounted on the drive shaft 134 of the electric operator. Extending around the sprocket 132 is an endless chain 136 which engages and turns the aforementioned sprocket 78.

The opening and closing of the door of FIGS. 1 to 6 is controlled by a top limit switch 138 and a bottom limit switch 140 (FIG. 3). The use and construction of such switches for rolling doors is well known in the art and a detailed description thereof is therefore deemed unnecesary. The limit switches are operated by a limit switch actuating pin 142 that is connected at a suitable location to the aforementioned chain loop 46.

The operation of the rolling door of FIGS. 1 to 6 will now be described commencing at the closed position with the gears in the position shown in FIG. 1. Suitable push buttons are provided at the side of the door at a location where they can easily be reached and these buttons include a raise button and a lower button. Such buttons for operating a rolling door are well known in the art. The raised button is pushed to energize the electric operator 130 and the electromechanical actuator 94. The piston member 100 retracts so as to move the fourth gear 82 away from the gear 66 and into engagement with the large drive gear 64. While this is occurring, the electric operator 130 commences to turn the drive sprocket 132 clockwise (as shown in FIG. 1). By means of the endless chain 136 and the gear 70, the fourth gear 82 is rotated counter-clockwise. When the gear 82 engages the drive gear 64, the spring hub absorbs the initial shock with its internal springs 112. The spring hub enables the drive gear 64 to rotate freely until the flat bar 114 engages the head of the bolt 126 at which time a positive type drive will occur and the shaft 14 will commence to rotate to open the door.

In order to close the door of FIGS. 1 to 6, the close button is pushed and again both the electric operator 130 and the actuator 94 are energized. The piston member 100 advances which causes the gear 82 to be pivoted away from the drive gear 64 and into engagement with the gear 66. While this is occuring, the electric operator 130 rotates the sprocket 132 counter-clockwise. This in turn causes the gear 70 to rotate counter-clockwise, thus resulting in the gear 82 rotating clockwise. The fourth gear 82 causes the gear 66 to rotate counter-clockwise and causes a positive type drive of the idler roller and the chain loops. The door will continue to lower until the actuating pin 142 engages the lower limit switch 140 or until a stop button is pushed. If the door is provided with a safety edge (not shown), the construction of which is well known, the contact of this edge with an object will also result in the door being stopped.

Figure 12:
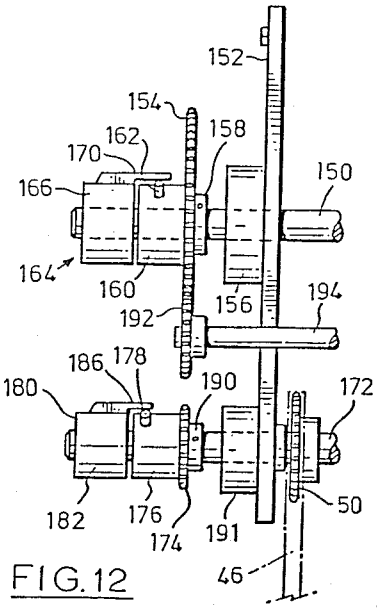
FIG. 12 is an elevational view taken along the line XII—XII of FIG. 11 and showing a floating clutch drive system for a rolling door.
Figure 11:
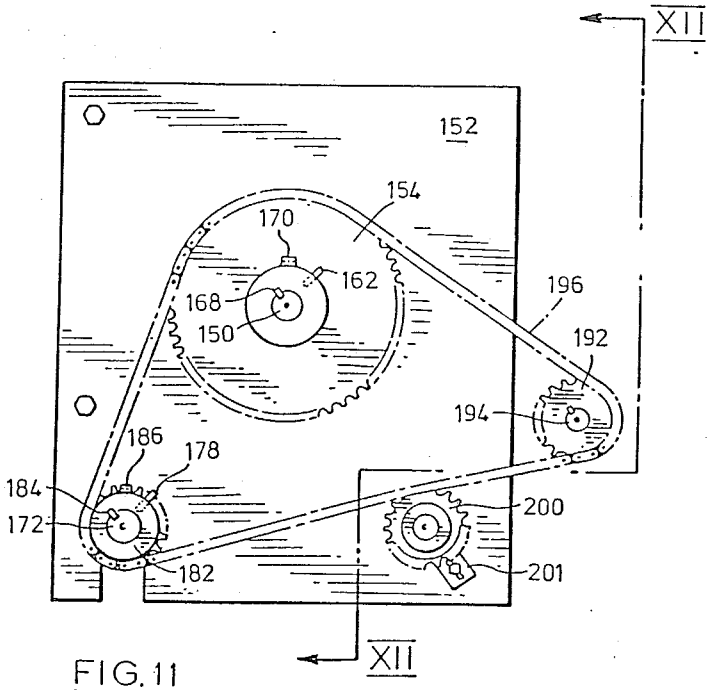
FIG. 11 is a vertical elevation showing a door operator constructed in accordance with the invention.
Figure 13:
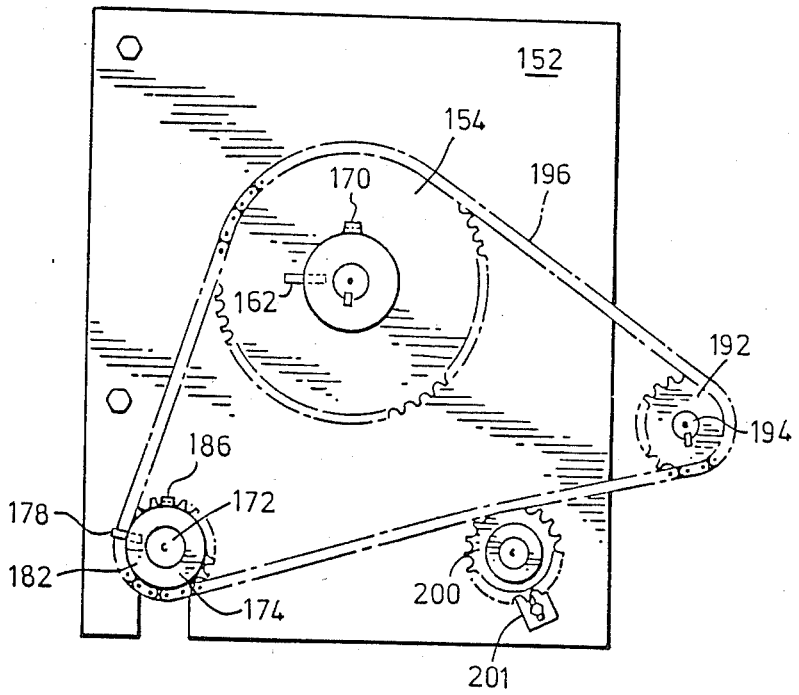
FIG. 13 is a vertical elevation similar to FIG. 11 but showing the clutch dogs and cooperating pins in a different position.

Turning now to the construction of the second embodiment, reference will be made to FIGS. 11 to 13 of the drawings. It will be understood that only those features of the second embodiment which differ from the construction used in the first embodiment will be described hereinafter. The second embodiment has many similar features compared to the first embodiment that has already been described. For example, it employs a chain loop on each side of the door to provide a means for pulling the flexible door down. There are also channel guides similar to those shown in FIGS. 5 and 6 of the drawings for enclosing and holding the vertical edges of the flexible door. The construction of the spring barrel on which the door is rolled is also the same in the second embodiment as in the first embodiment.

The flexible door is rolled about a spring barrel mounted on a main or first shaft 150 that is supported by rigid support brackets 152 near each end. In order to rotatably support the shaft 150, a suitable support bearing 156 is connected to the outer surface of the bracket 152 as shown in FIG. 12. Mounted on the shaft 150 out from the bearing 156 is drive sprocket means 154. To limit axial movement of sprocket 154 on shaft 150, there is a stop collar 158 arranged on the shaft next to sprocket means 154. The drive sprocket 154 is mounted for free rotation on the shaft 150. The sprocket 154 is provided with a hub 160 having a pin 162 projecting from one side thereof. The pin 162 provides dog engaging means as explained further hereinafter. Mounted outwardly from the hub 160 is a first dog means 164 fixedly connected to the end of the first shaft 150. The dog means comprises a circular hub 166 having a hole therein for passage of the shaft 150. The dog means 164 is prevented from rotating on the shaft by a suitable key 168 which fits into a key seat formed on the inside surface of the hub 166. Welded to the outside of the hub is a clutch dog 170 that extends axially and inwardly from the hub 166. A suitable hole (not shown) can be provided in the side of the hub 166 for a set screw to hold the dog means firmly in position on the shaft.

Second shaft means 172 extend from opposite ends of the idler roller. Second sprocket means 174 are mounted for free rotation on the second shaft means at one end of the idler roller. The second sprocket means includes a circular hub 176 having a pin 178 projecting from the side thereof. The pin 178 can take the form of a $\frac{3}{8}''$ bolt threaded into a hole in the hub. Mounted next to the second sprocket means is second dog means 180 fixedly connected to the second shaft. The second dog means includes a circular hub 182 that is fixed against rotation on the shaft by a key 184. A clutch dog 186 is rigidly connected to one side of the hub and extends axially and inwardly from the hub. Mounted next to the second sprocket means is an idler shaft stop collar 190 that limits axial movement of sprocket 174 on shaft 172. Mounted on the outside surface of the bracket 152 is an idler shaft support bearing 191. Arranged on the inside of the bracket 152 on the second shaft is the upper sprocket 50 for the chain loop.

As with the first embodiment power means, preferably in the form of an electric operator, are provided to open and close the door. The power means are operatively connected to a third sprocket 192 that is keyed for rotation with a drive shaft 194. An endless chain 196 extends about and engages the drive sprocket means 154, the second sprocket means 174 and the third sprocket 192. Thus, rotation of the sprocket 192 will effect rotation of both the large drive sprocket and the second sprocket.

Preferably there is also provided a fourth sprocket 200 for tightening the endless chain 196. It will be understood that the position of the sprocket 200 is adjustable to remove or increase the slack in the endless chain by means of tightener base 201. An adjustable sprocket of this type is well known in the chain drive art and therefore further description of its construction is deemed unnecessary. The sprocket 200 is rotatably mounted on the bracket 152.

The operation of the door using the floating clutch drive system of FIGS. 11 to 13 will now be described with reference to these figures. Starting at the closed position for the door, the raise button is pushed and the electric operator (such as the operator 130 shown in FIG. 1) is energized. At this moment the pin 162 and the dog 170 are in the positions shown in FIG. 13. The pin 178 is located to the right of the dog 186 as shown in FIG. 11 but they are in contact with one another. The third sprocket 192 rotates clockwise to open the door and rotates the drive sprocket !54 and the second sprocket 174 in the same direction. The drive sprocket 154 continues to be turned about the shaft 150 until the pin 162 contacts the dog 170, which contact results in a positive drive. While this is occuring, the pin 178 does not contact the dog 186 but instead moves away from this dog. As soon as positive drive of the shaft 150 takes place, the flexible curtain that forms the door begins to roll up. When this takes place, the endless chain loops passing around the sprockets 50 are rotated or moved as required. As the door curtain is raised, the distance between the pin 178 and the second dog 186 varies due to the variable velocity of the curtain. The velocity of the curtain varies because of the growing thickness of the rolled up portion of the curtain. While the curtain is rising for the first half cycle, the second dog 186 turns slower than the pin 178 causing the pin and the dog to be spread further apart. Eventually the location of the pin 178 relative to the dog 186 is similar to that shown in FIG. 13. After the curtain has been raised past the half opened point, the diameter of the rolled curtain on the barrel has increased enough to cause the curtain velocity to increase significantly. This in turn causes the dog 186 to turn faster than the pin 178, thereby closing the gap between them. Only when the door curtain has reached its top most position does the pin 178 contact the dog 186. The curtain stops when it reaches the top due to internal rotary limits or as a result of an engagement of the upper limit switch described earlier.

In order to close the door of the second embodiment, the close button is pushed causing energization of the electric operator. At this time the pin 162 is to the left of the dog 170 as shown in FIG. 13 but they contact each other. Also, the pin 178 is to the right of the dog 186 as shown in FIG. 11 but again they contact each other. The sprocket 192 is rotated counter-clockwise which causes the main drive sprocket and the second sprocket 174 to be rotated in the same direction. The pin 178 now has a positive drive with the dog 186 in order to lower the curtain. The pin 162 does not drive the dog 170 in this direction of rotation. As the door curtain is lowered, the distance between the pin 162 and the dog 170 varies due to the diameter of the rolled curtain decreasing. The rotational velocity of the dog 170 varies while the rotational velocity of the pin 162 remains constant. Thus, as the curtain is lowered, the pin 162 and the dog 170 spread apart since the pin is turning faster than this dog. When the curtain is in the half closed position, the pin 162 will have moved away from its dog to the approximate position shown in FIG. 11. While the curtain is closing during the last half of the cycle, the dog 170 begins to turn faster than its pin 162 thus closing the gap between them. When the curtain has been fully closed, the location of the pin 162 and its dog is as shown in FIG. 13. At this time, the pin 178 is to the right of the dog 186 and is in contact therewith. The curtain is stopped at the bottom of its movement by internal rotary limits or by an engagement of the lower limit switch.

It will be appreciated by those skilled in the art that a power operator has been described which enables a flexible rolling door to be operated in a reliable manner, even when pressure differences exist on opposite sides of the door. The present power operator enables the flexible door to be closed by providing a means for pulling the bottom edge of the door downwards. Thus, the door can close even when pressure differences cause considerable friction between the edges of the door and the channel guides in which the edges are arranged.

It will be obvious to those skilled in the industrial door art that various modifications and changes can be made to the described door and operating systems without departing from the spirit and scope of this invention. Accordingly, all such modifications and changes as fall within the scope of the appended claims are intended to be part of this invention.

I therefore claim:

1. An operator for a rolling door comprising a first shaft rotatable for actuating the door, drive sprocket means mounted for free rotation on one end of said first shaft, an idler roller, said idler roller in use engaging one surface of said door and extending horizontally across a top of an opening to be closed by said door, a second shaft for rotatably mounting said idler roller, second sprocket means mounted for free rotation on one end of said second shaft, a third sprocket for mounting on a drive shaft of power means for opening and closing said door, an endless chain extending about and engaging said drive sprocket means, second sprocket means and third sprocket, first dog means fixedly connected to said first shaft, said drive sprocket means including means for engaging said first dog means so that upon engagement said drive sprocket means can rotate said first shaft, second dog means fixedly connected to said second shaft, said second sprocket means including means for engaging said second dog means so that upon engagement said second sprocket means rotates said second shaft, endless chain loop means connectable to said door and provided for closing said door, and upper and lower sprocket means for guiding and moving said chain loop means, said lower sprocket means being adapted to be rotably mounted near the bottom of said opening and said upper sprocket means being mounted on said second shaft, wherein said door is opened by a driving connection extending from said third sprocket to said endless chain to said drive sprocket means and said door is closed by a driving connection extending from said third sprocket to said endless chain to said second sprocket means to said upper sprocket means and finally to said chain loop means.

2. An operator according to claim 1 including means for tightening said endless chain.

3. An operator according to claim 2 wherein each of said dog engaging means comprises pin means provided on a hub of the respective sprocket means.

4. An operator according to claim 1 wherein each of said dog means comprises a circular hub connectable to the respective shaft and a clutch dog rigidly connected to one side of the hub and extending axially and inwardly from said hub.

5. An operator according to claim 2 wherein said tightening means is a sprocket the position of which is adjustable to take up slack in said endless chain.

6. An operator according to claim 1 wherein said power means includes an electric motor and said third sprocket can be rotated in either direction to operate said door.

7. A power operator for a rolling door comprising a first rotatable shaft with a barrel arranged thereon, said barrel being adapted for a door to be rolled up thereon, drive sprocket means mounted for free rotation on one end of said first shaft, an idler roller for engaging one surface of said door and adapted to extend horizontally across a top of an opening to be closed by said door, second shaft means extending from opposite ends of said roller, second sprocket means mounted for free rotation on said second shaft means at one end of said roller, power means for opening and closing said door, a third sprocket operatively connected to said power means, an endless chain extending about and engaging said drive sprocket means, second sprocket means and third sprocket, first dog means fixedly connected to an end of said first shaft, said drive sprocket means including means for engaging said first dog means so that upon engagement said drive sprocket can rotate said first shaft in order to open said door, second dog means fixedly connected to said second shaft means, said second sprocket means including means for engaging said second dog means so that upon engagement said second sprocket means can rotate said second shaft means in order to close the door, endless chain loop means connectable to said door and provided for closing said door, and upper and lower sprocket means for guiding and moving said chain loop means, said lower sprocket means being adapted to be rotatably mounted near the bottom of said opening and said upper sprocket means being mounted on said second shaft means for rotation therewith.

8. A power operator according to claim 7 including sprocket means for tightening said endless chain.

9. A power operator according to claim 7 wherein each of said first mentioned sprocket means and said second sprocket means has a hub and each of said dog engaging means comprises pin means provided on the hub of the respective sprocket means.

10. A power operator according to claim 9 wherein each of said dog means comprises a circular hub connectable to the respective shaft and a clutch dog rigidly connected to one side of the circular hub and extending axially and inwardly from said circular hub.

11. A power operator for a rolling door comprising a first rotable shaft with a barrel arranged thereon, said barrel being adapted for a door to be rolled up thereon, drive sprocket means mounted for free rotation on one end of said first shaft, an idler roller for engaging one surface of said door and adapted to extend horizontally across a top of an opening to be closed by said door, second shaft means extending from opposite ends of said roller, second sprocket means mounted for free rotation on said second shaft means at one end of said roller, power means for opening and closing said door, a third sprocket operatively connected to said power means, an endless chain extending about and engging said drive sprocket means, second sprocket means and third sprocket, first means for selectively transmitting rotational power from said third sprocket to said drive sprocket means via said endless chain in order to open said door, second means for selectively transmitting rotational power from said third sprocket to said second sprocket means via said endless chain in order to close said door, and two endless chain loops for operatively connecting a bottom end of said door to said second shaft means, said chain loops being mounted on opposite vertical sides of the opening to be closed by said door, upper and lower sprockets for mounting and guiding each endless chain loop, each lower sprocket adapted to be rotatably mounted near the bottom of said opening and each upper sprocket being mounted on said second shaft means for rotation therewith, whereby rotation of said second shaft means in one direction will cause said door to be pulled toward the closed position.

* * * * *